US006588124B2

(12) United States Patent
Morrone

(10) Patent No.: US 6,588,124 B2
(45) Date of Patent: Jul. 8, 2003

(54) BALLET SHOE SOLE WITH GUSSET

(75) Inventor: Peter Morrone, Huntington, NY (US)

(73) Assignee: Ballet Makers, Inc., Totowa, NJ (US)

( * ) Notice: Subject to any disclaimer, the term of this patent is extended or adjusted under 35 U.S.C. 154(b) by 0 days.

(21) Appl. No.: 09/928,675

(22) Filed: Aug. 13, 2001

(65) Prior Publication Data

US 2003/0029055 A1 Feb. 13, 2003

(51) Int. Cl.[7] ..... A43B 5/12; A43B 3/14; A43B 1/10; A43B 3/00

(52) U.S. Cl. ..... 36/8.3; 36/11; 36/102; 36/113; 12/142 G; 12/142 MC

(58) Field of Search ..... 36/8.3, 113, 9 R, 36/11, 21, 26, 45, 18, 102, 25 R; 12/146 L, 146 S, 142 G, 142 MC

(56) References Cited

U.S. PATENT DOCUMENTS

| | | | | | |
|---|---|---|---|---|---|
| 1,872,641 | A | | 8/1932 | Capezio | |
| 2,648,080 | A | * | 8/1953 | Garofalo | 36/45 |
| 2,683,316 | A | * | 7/1954 | Reker et al. | 36/8.3 |
| 2,926,433 | A | * | 3/1960 | Kramer | 12/142 G |
| 3,404,468 | A | * | 10/1968 | Rosen | 36/11 |
| 4,519,148 | A | | 5/1985 | Sisco | |
| 4,554,749 | A | | 11/1985 | Ostrander | |
| 4,583,304 | A | * | 4/1986 | Spalding | 36/8.3 |
| RE33,018 | E | * | 8/1989 | Ostrander | 36/9 R |
| 4,901,453 | A | | 2/1990 | Gaynor | |
| 4,908,961 | A | | 3/1990 | Purslow et al. | |
| 5,035,069 | A | | 7/1991 | Minden | |
| 5,220,735 | A | | 6/1993 | Raoul-Duval | |
| 5,682,685 | A | * | 11/1997 | Terlizzi | 36/25 R |

* cited by examiner

*Primary Examiner*—Anthony D. Stashick
(74) *Attorney, Agent, or Firm*—Lerner, David, Littenberg, Krumholz & Mentlik, LLP

(57) ABSTRACT

A ballet shoe that includes a front shoe upper which defines a front portion of the shoe, a rear shoe upper which defines a rear portion of the shoe, and a gusset located at the underfoot and between the front portion of the shoe and the rear portion of the shoe to define a central portion of the underfoot of the shoe. The gusset has a generally diamond shape with an apex toward the front portion and an apex toward the rear portion. The front and rear portions of the shoe are complementary shaped to the shape of the gusset. The gusset extends completely across the central underside portion of the shoe, so that there is no seam extending longitudinally under the central portion of the shoe.

13 Claims, 4 Drawing Sheets

BALLET SHOE SOLE WITH GUSSET

BACKGROUND OF THE INVENTION

The present invention relates to a ballet shoe or ballet slipper and particularly to the construction of the underside of the shoe. More particularly, the present invention relates to an improved ballet shoe construction with the central bottom portion of the shoe comprising a gusset which should reduce the discomfort on the wearer's foot usually associated with a seam in the shoe usually located along the central bottom portion of the shoe.

Ballet shoes or ballet slippers are typically formed with the shoe upper folded under and beneath the foot to define the bottom of the shoe. Typically, two separate, left and right front and two separate left and right, rear portions are attached together to form the shoe and the upper portions are folded under the underside of the shoe. Thus, the front portions are attached to the rear portions at a seam that extends across the shoe. As the bottom of the shoe is formed by material that is brought down from the shoe upper and then folded under the shoe, there is typically a seam in the bottom of the shoe between the left and right shoe upper portions that extends longitudinally along the shoe from the region of the front toward the heel, and runs the length of the underside of the shoe. That seam may be unsightly and/or uncomfortable for the wearer.

DESCRIPTION OF A PRIOR ART EMBODIMENT

A traditional ballet shoe or slipper and its main components are shown in FIGS. 1 and 2. FIG. 1 shows the ballet shoe as assembled, and FIG. 2 shows the main component parts of the shoe as they appear when cut from a blank of material. This ballet shoe includes a front shoe upper 2 which has a front edge 3 that is folded under the shoe and the material is gathered together to form a front pleated bottom portion 5 of the shoe. The ballet shoe also includes two rear shoe uppers 4*a* and 4*b* which are sewn together and folded under the shoe to together form a rear bottom portion of the shoe. To maintain the shoe shape, the front shoe upper 2 is sewn together along its opposite outward edges 12*a* and 12*b* to form a longitudinal seam 12 which extends toward the rear portion of the shoe, and the two rear shoe uppers 4*a* and 4*b* are sewn together along their respective opposite, laterally outward edges 14*a* and 14*b* to form a longitudinal seam 14 which extends toward the front portion of the shoe. The front and rear upper portions are thereafter attached to each other along confronting edges 10*a* and 10*c* from the front and 10*b* and 10*d* from the rear portions to form a seam 10 which extends transversely across the shoe. Thus, the attachment of the shoe upper parts causes the seams 12 and 14 form a continuous seam which extends longitudinally along the shoe. Respective front and rear outer sole portions 6 and 8 are then sewn under each of the front and rear shoe portions, respectively.

As shown in FIG. 1, this traditional construction of a ballet shoe creates at least two seams which respectively extend longitudinally and transversely along the bottom of the shoe. These seams may be unsightly and/or uncomfortable for the wearer. Also, the point 17 at which all of the seams 10, 12 and 14 meet forms an overlap which is greater in thickness than each of the seams and the thickness of the material used for each of the uppers. This may be a lump in the middle of the bottom of the shoe which may press against the bottom of the wearer's foot.

Alternatively, the entire shoe upper may be made of a single piece of material. Considering the large area to be covered, namely the upper and all of the underside of the foot, a large dimension blank of material must be cut for defining the entire shoe upper and the bottom of the shoe. This large area blank is irregularly shaped to fit the foot and around the ankle. It is cut from a large sheet, and cutting its shape leaves a considerable amount of unusable waste material, as contrasted with using blanks of material which are smaller sized and irregularly shaped pieces but can be more compactly arranged next to each other, for the more economical use of the material and a smaller amount of waste or scrap material.

SUMMARY OF THE INVENTION

It is the primary object of the present invention to provide a dance shoe or slipper which does not require a seam which extends longitudinally along the central underside portion of the shoe.

Another object is to increase the comfort of the shoe of the wearer's foot.

Another object of the present invention is to reduce the size of a blank of material needed for forming the shoe including the bottom of the shoe.

A ballet shoe according to the present invention has a front shoe upper which defines a front portion of the shoe and a rear shoe upper which defines a rear portion of the shoe. The front edge of the front shoe upper is folded under the bottom of the shoe at the toe area in the usual manner to form a front pleated underfoot portion. The rear shoe upper includes a portion that is long enough to be folded under the bottom of the shoe at the heel area to define the rear portion of the shoe. Preferably, the rear shoe upper is divided into two separate left and right rear sections which are shaped to meet at the heel of the shoe so that the rear portion of the shoe has a seam that extends along the rear portion of the calcaneus or heel bone.

The invention comprises an extra piece of material, or gusset, disposed between the front portion of the shoe and the rear portion of the shoe and which defines a central portion of the shoe. Preferably, the forward and rearward edges of the gusset are attached by stitching to the confronting rearmost edge of the front portion and frontmost edge of the rear portion. The gusset preferably has a generally diamond shape, with an apex toward the front and an apex toward the rear, and the confronting edges of the front and rear portions of the shoe are shaped complementary to the shape of the gusset edges. The gusset extends completely laterally across the underside of the shoe, avoiding a seam which extends longitudinally along the central underfoot portion of the shoe.

Further, as the gusset is a separate piece of material, the blanks for forming the front and rear portions of the shoe may be smaller sized irregular geometric shapes. These smaller shapes enable more economical placement of the patterns for forming the blanks from a large sheet of material, such that less material is wasted when the sheet is cut to form the blanks for the various parts of the shoe.

Other features and advantages of the present invention will become apparent from the following description of a preferred embodiment considered in conjunction with the accompanying drawings.

DETAILED DESCRIPTION OF A PREFERRED EMBODIMENT

The invention is described herein in conjunction with a ballet shoe. This is one example of the many possible shoe applications for the invention, other applications being evident from the following detailed description.

Figure 1:
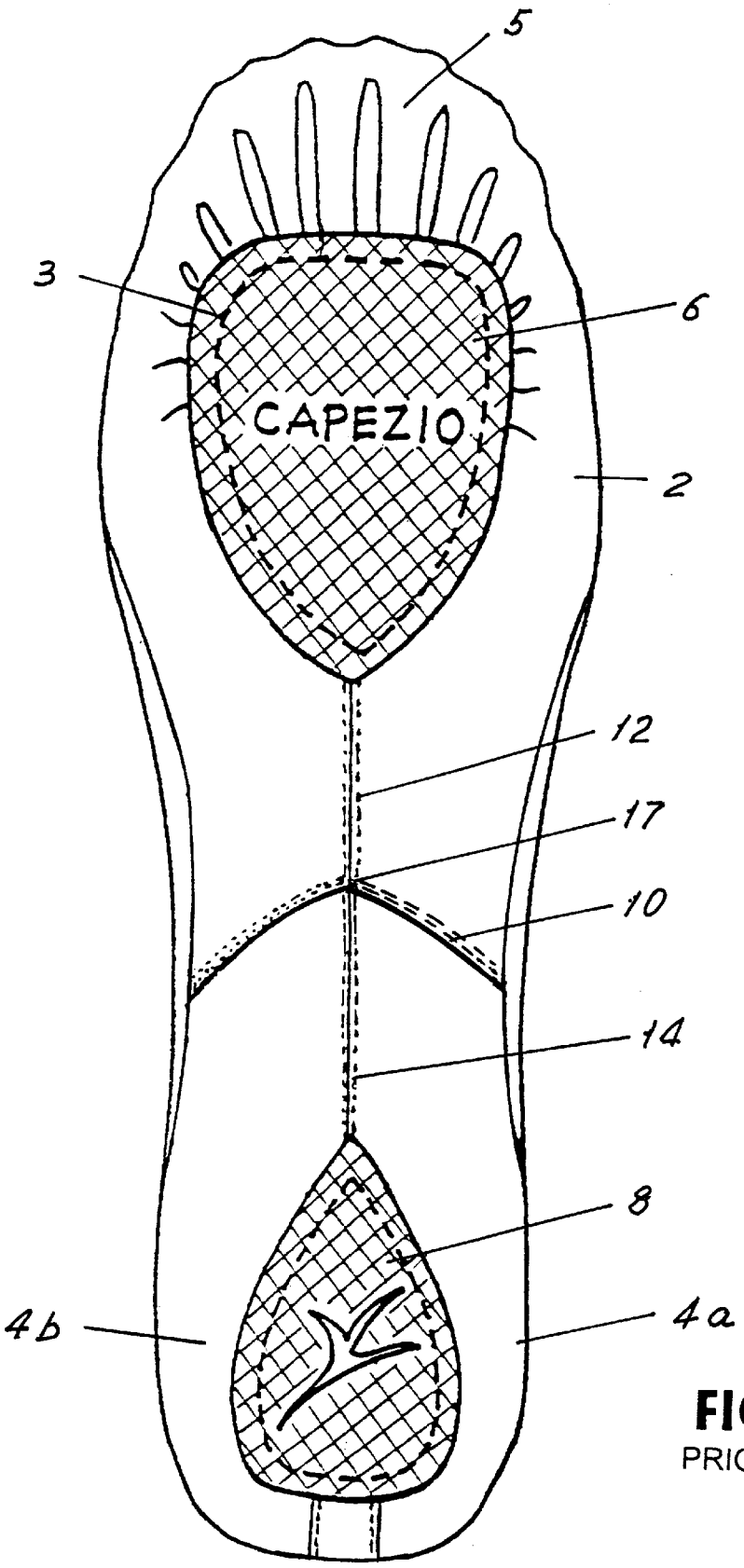
FIG. 1 PRIOR ART
FIG. 1 is a bottom plan view of a traditional ballet shoe.
Figure 2:
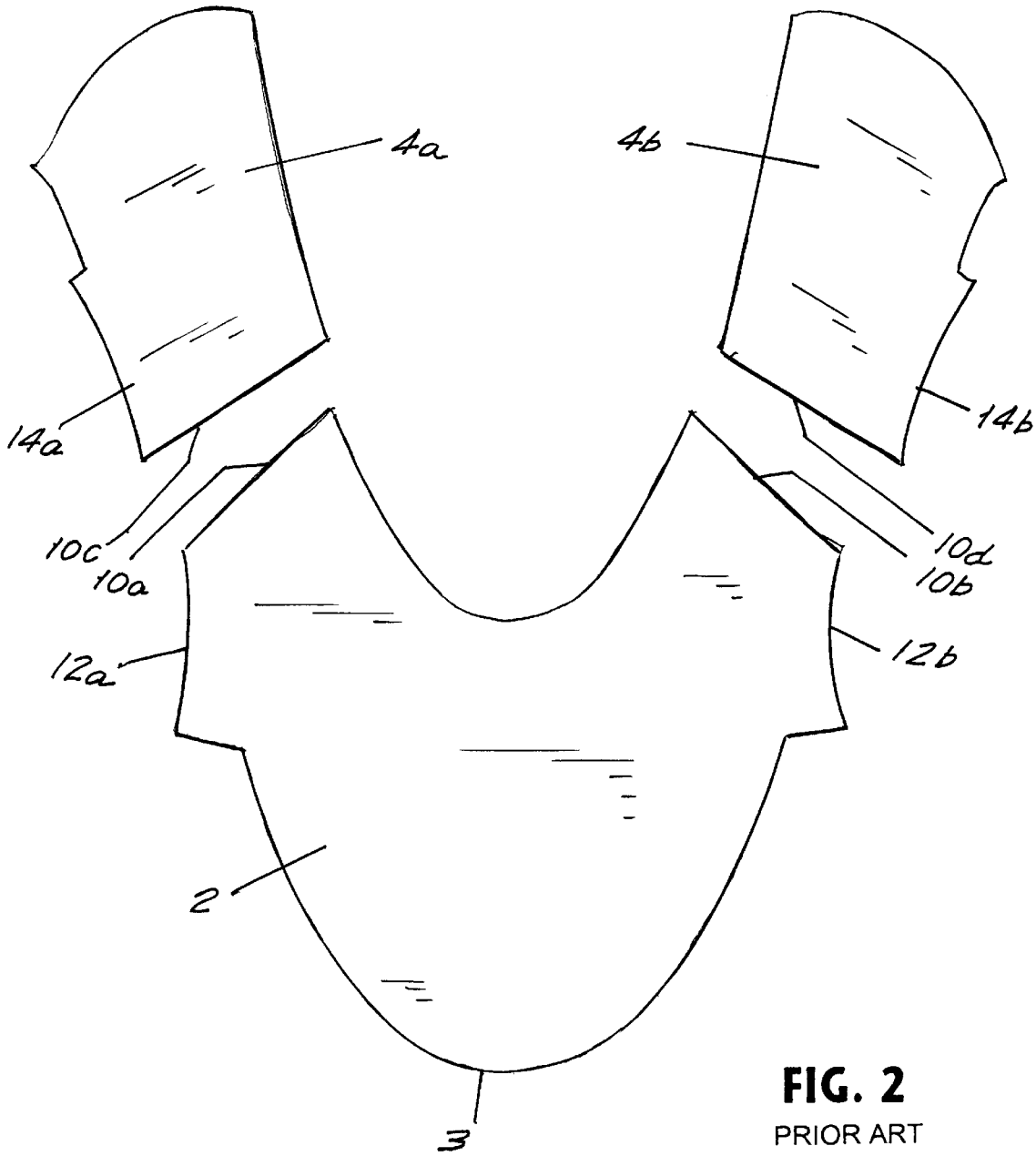
FIG. 2 PRIOR ART
FIG. 2 is a top plan view showing the unassembled shoe upper components of the ballet shoe of FIG. 1.
Figure 3:
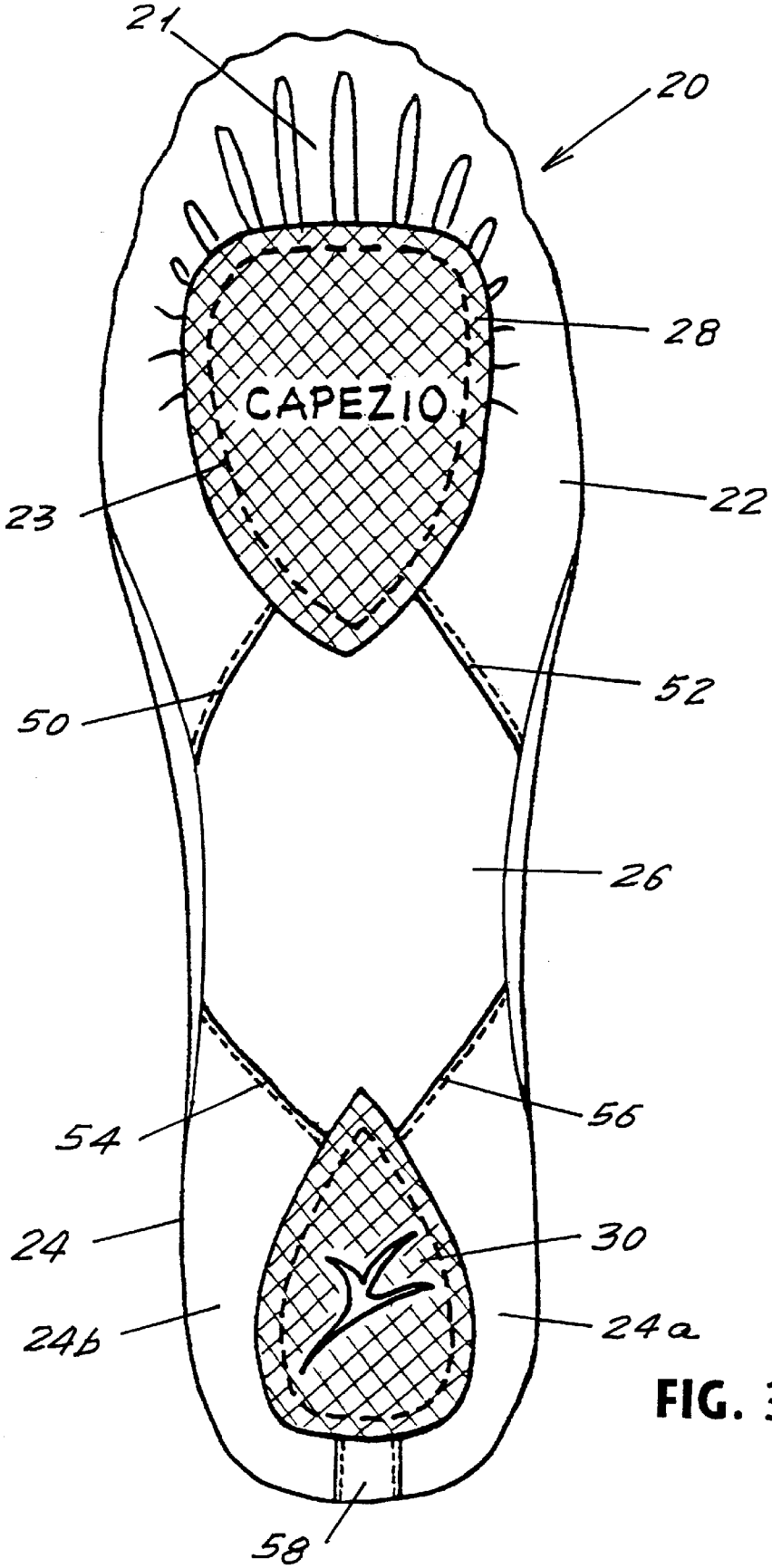
FIG. 3 is a bottom view of a ballet shoe according to the present invention.
Figure 4:
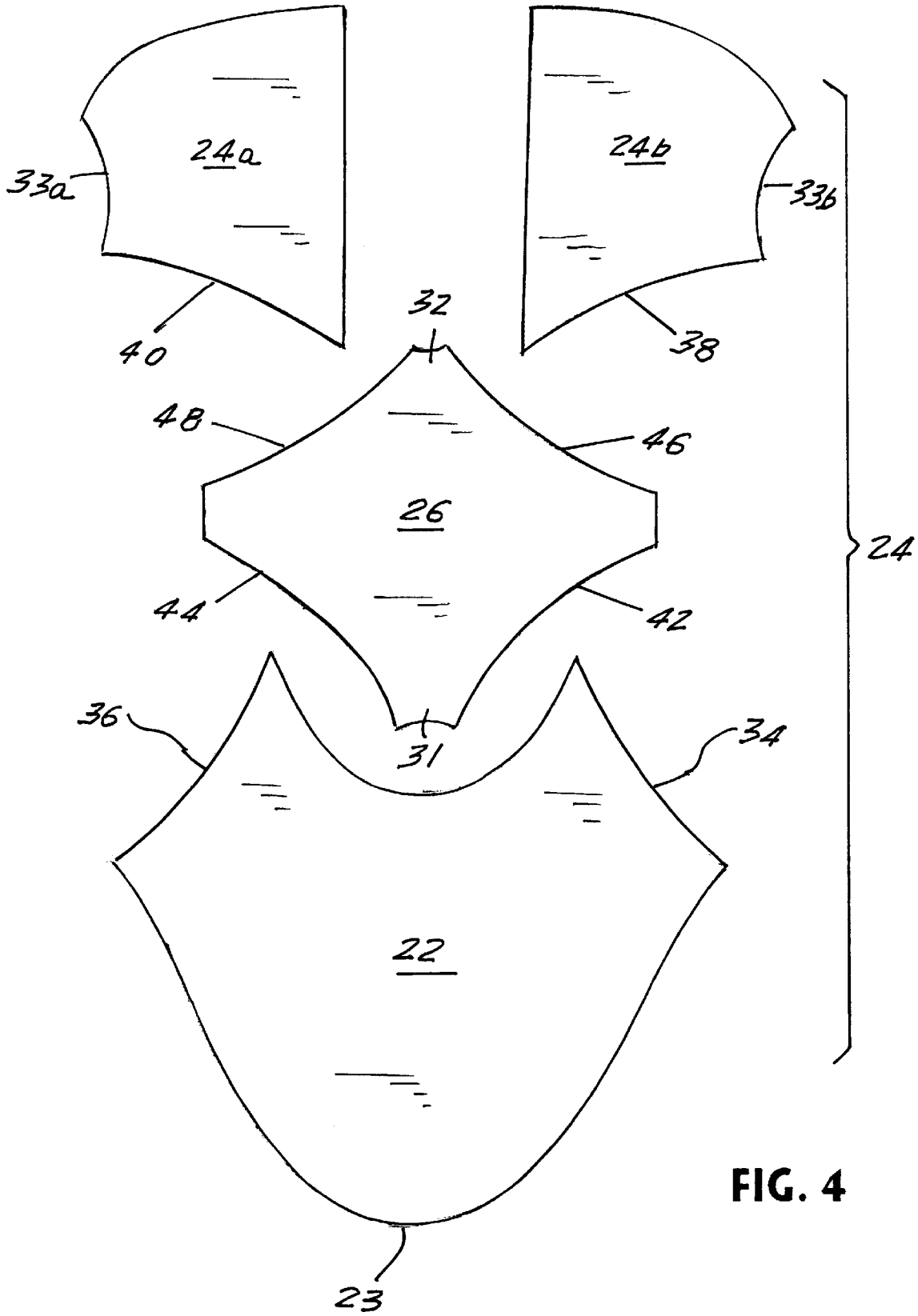
FIG. 4 is a top plan view showing the unassembled shoe upper components and gusset of the ballet shoe of FIG. 3.

A traditional shoe is shown in FIGS. 1 and 2. FIGS. 3 and 4 show a ballet shoe 20 of the present invention. The ballet shoe 20 comprises a front shoe upper 22 which forms a front part of the shoe, a rear shoe upper 24 which forms a rear portion of the shoe and a gusset 26 which forms a central portion of the shoe.

FIG. 4 shows each of the shoe components as a blank cut from a sheet of material. Preferably, the material used to construct the shoe is a flexible, substantially inelastic material such as a conventional dance shoe leather or fabric. The front shoe upper 22 has a first lateral and rear attachment edge 34, a second, opposite, lateral and rear attachment edge 36 and a front edge portion 23. The front edge portion 23 is configured to be folded into an integral front pleated underfoot portion 21 that extends beneath the toe area of the wearer's foot (see FIG. 3). The front shoe upper 22 is also preferably cut from the blank in a preformed shape which lends itself to folding into the front underfoot portion of the shoe.

As shown in FIG. 4, the rear shoe upper 24 is preferably divided into two substantially identical symmetrical rear upper portions 24*a* and 24*b*. Each shoe rear portion 24*a* and 24*b* includes an integral rear portion 33*a* and 33*b* which are configured to be folded under into an integral rear underfoot portion and cooperate to form the rear underfoot portion of the shoe that extends below the heel area of the wearer's foot when assembled. These rear portions are preferably sized such that they can be folded under the heel area to define the rear portion of the shoe. When sewn, the divided rear portions meet at the heel of the shoe so that the rear shoe upper 24 has a seam 58 that extends along the rear portion of the calcaneus or heel bone of the wearer's foot. The rear portions have respective forward third attachment edge 38 and fourth attachment edge 40 that are attached to the gusset 26. Alternatively, as opposed to being formed from two separate pieces, the rear shoe upper 24 may be formed from a single piece of material that is cut into a shape which lends itself to folding into a rear underfoot portion of the shoe similar to that described above.

Preferably, as shown in FIG. 4, the gusset 26 is a diamond shape blank cut from material to include a forward apex 31 and a rearward apex 32, which extend toward the front shoe upper 22 and the rear shoe upper 24, respectively. The gusset includes a first attachment edge 42 and a second attachment edge 44 which are shaped complementary to the first rearmost edge 34 and second rearmost edge 36, respectively, of the front shoe upper 22, and a third attachment edge 46 and a fourth attachment edge 48 which are shaped complementary to the first frontmost edge 38 and second frontmost edge 40, respectively, of the rear shoe upper portions 24*a* and 24*b*. With this shape, the gusset 26 defines a continuous central underfoot portion which does not have a longitudinal seam extending under the central portion of the shoe when each of the attachment edges of the gusset are attached to their respective attachment edges of the front and rear shoe uppers.

To form the basic shell of the ballet shoe, the first 42 and second 44 attachment edges of the gusset 26 are respectively sewn to the first rearmost edge 34 and second rearmost edge 36 of the front shoe upper 22 to form seams 50 and 52, and the third 46 and fourth 48 attachment edges of the gusset 26 are respectively sewn to the first frontmost 38 and second frontmost 40 edges of the rear shoe upper 24*a*, 24*b* to form seams 54 and 56, shown in FIG. 3.

As shown in FIG. 3, the ballet shoe 20 also includes a first sole portion 28 stitched in place under the front underfoot portion of the shoe and connected to the front shoe upper 22, and a second sole portion 30 stitched under the rear underfoot portion of the shoe and connected to the rear shoe upper 24. The first sole portion 28 and the second sole portion 30 respectively form a front sole of the shoe and a rear sole of the shoe.

Also, and as shown in FIG. 3, if the outline of the front shoe upper 22 and the rear shoe upper 24 are such that an opening is created at the front underfoot portion and/or the rear underfoot portion of the shoe when the respective front and rear portions are folded and sewn, the first and second sole portions 28 and 30 cover those openings and complete the shoe construction.

Accordingly, depending upon the outline of the front shoe upper 22 and the rear shoe upper 24, appropriately shaped sole portions may be sewn to complete the shell of the ballet shoe. The shoe is preferably then finished by adding any decorations, lacing, strapping, inner linings, cushioning, elastic members around the foot opening and/or any other finishing treatments.

As shown in the drawings and described above, the construction of the ballet shoe with a gusset eliminates the seam which extends longitudinally along the central underfoot portion of the shoe. Avoiding a longitudinal seam improves the comfort of the shoe on the wearer's foot. Also, the use of multiple portions having irregular shapes allows for the economical use of the sheet of material from which the blanks are cut, thereby reducing the amount of scrap generated during manufacture.

The above preferred embodiment has been described as having the respective portions of the ballet shoe sewn together with stitching. It will be evident, however, that any other suitable affixing method, such as gluing or stapling, for example, may be used to secure the portions together to form the ballet shoe.

Although the present invention has been described in relation to a particular embodiment thereof, many other variations and modifications and other uses will become apparent to those skilled in the art. It is preferred, therefore, that the present invention be limited not by the specific disclosure herein, but only by the appended claims.

What is claimed is:

1. A ballet shoe comprising:

a shoe upper having a front region and having a rear region;

a front underfoot portion of the shoe connected with the front region of the upper and extending under the front of the foot;

a rear underfoot portion connected with the rear region of the shoe upper and extending under the heel region of the foot; the front region having a rearmost edge and the rear region having a frontmost edge opposed to the rearmost edge, the front and rear regions being so shaped and sized that the opposing rearmost and frontmost edges, respectively, of the regions are spaced apart; and a gusset between and connected to each of the front and rear underfoot portions, the gusset having a front edge connected to the rearmost edge and a rear edge connected to the frontmost edge so that the gusset extends under the central region of the foot for completing an underfoot covering for the shoe; the gusset being continuous between lateral sides of the shoe without a longitudinal seam extending along the gusset at the central region of the foot.

2. The ballet shoe of claim 1, wherein the gusset is generally diamond shaped, including opposite forward and rearward edges defining a respective forward and rearward apex respectively toward the front and rear underfoot portions of the shoe; and the opposing edges of the front and rear underfoot portions being shaped complementary to the edges of the gusset where the gusset meets the front and rear underfoot portions.

3. The ballet shoe of claim 2, wherein the rear region is comprised of two substantially identical symmetric, left and right rear upper portions.

4. The ballet shoe of claim 1, further comprising a front outer sole portion at the underside of the front underfoot portion and a rear outer sole portion at the underside of the rear underfoot portion.

5. The ballet shoe of claim 4, wherein the gusset does not have a separate sole portion thereunder separate from the front and rear outer soles.

6. The ballet shoe of claim 1, wherein the front underfoot portion is integral with the front region of the shoe upper and is folded off the front region of the shoe upper into the front underfoot portion;

the rear underfoot portion is integral with the rear region of the shoe upper and is folded off the rear region of the shoe upper into the rear underfoot portion;

and the gusset is a separate part attached to the front underfoot portion and the rear underfoot portion and to the shoe upper.

7. The ballet shoe of claim 1, wherein the front region of the shoe upper and the rear region of the shoe upper are separate parts which are joined to each other upward from the front underfoot portion and the rear underfoot portion and joined to the gusset.

8. The ballet shoe of claim 1, wherein the rear region is comprised of two substantially identical symmetric, left and right rear upper portions.

9. A ballet shoe comprising:

a front shoe upper having a first rearmost edge, a second rearmost edge and a front portion configured to be folded into an integral front underfoot portion;

a rear shoe upper having a first frontmost edge, a second frontmost edge and a rear portion configured to be folded into an integral rear underfoot portion; and a gusset having a first attachment edge and a second attachment edge which are shaped complimentary to the first rearmost and second rearmost edges, respectively, and a third attachment edge and a fourth attachment edge which are shaped complimentary to the first frontmost and second frontmost edges, respectively, the gusset shaped to be formed into a continuous central underfoot portion of the shoe without a longitudinal seam extending along the central underfoot portion and attached to the first and second rearmost edges of the front shoe upper and the first and second frontmost edges of the rear shoe upper.

10. The ballet shoe of claim 9, wherein the fifth through eighth attachment edges of the gusset are arranged in a generally diamond shape.

11. The ballet shoe of claim 9, further comprising:

a front sole at the front underfoot portion; and a rear sole at the rear underfoot portion.

12. The ballet shoe of claim 9, wherein the rear shoe upper comprises two substantially identical symmetrical rear upper portions.

13. The ballet shoe of claim 9, wherein the front shoe upper, the rear shoe upper and the gusset are sewn together along their respective attachment edges to form the ballet shoe.

* * * * *